US007726058B2

(12) United States Patent
Richards

(10) Patent No.: US 7,726,058 B2
(45) Date of Patent: Jun. 1, 2010

(54) MUZZLELOADER FIREARM WITH QUICK-RELEASE BREECH PLUG

(76) Inventor: Marlowe R. Richards, 225 W. 1100 S., Orem, UT (US) 84058

( * ) Notice: Subject to any disclaimer, the term of this patent is extended or adjusted under 35 U.S.C. 154(b) by 280 days.

(21) Appl. No.: 11/122,668

(22) Filed: May 4, 2005

(65) Prior Publication Data

US 2006/0248771 A1 Nov. 9, 2006

(51) Int. Cl.
*F41C 7/00* (2006.01)

(52) U.S. Cl. ..... 42/51

(58) Field of Classification Search ..... 42/51
See application file for complete search history.

(56) References Cited

U.S. PATENT DOCUMENTS

| | | | | | |
|---|---|---|---|---|---|
| 1,410,525 | A * | 3/1922 | Asbury | 89/166 |
| 2,094,156 | A * | 9/1937 | Johnson, Jr. | 89/172 |
| 2,146,743 | A * | 2/1939 | Johnson, Jr. | 89/172 |
| 2,882,634 | A * | 4/1959 | Smith | 42/16 |
| 3,005,279 | A * | 10/1961 | Brewer | 42/18 |
| 3,013,355 | A * | 12/1961 | Weatherby | 42/16 |
| 3,386,336 | A * | 6/1968 | Roy | 89/128 |
| 3,653,140 | A * | 4/1972 | Alday | 42/16 |
| 5,606,817 | A * | 3/1997 | Sachse | 42/51 |
| 5,644,861 | A * | 7/1997 | Knight | 42/51 |
| 5,718,073 | A * | 2/1998 | Sachse et al. | 42/51 |
| 2001/0029687 | A1* | 10/2001 | Hashman | 42/16 |
| 2003/0126781 | A1* | 7/2003 | Herring | 42/18 |
| 2005/0188578 | A1* | 9/2005 | Engel | 42/16 |

OTHER PUBLICATIONS

Definition of Breech Plug, www.thefreedictionary.com/Breech+plug, retrieved Jun. 4, 2009.*

* cited by examiner

*Primary Examiner*—Troy Chambers
(74) *Attorney, Agent, or Firm*—David R. McKinney

(57) ABSTRACT

A muzzleloader firearm has a barrel with at least one lug retaining structure that includes an internal annular groove and an internal annular shoulder that is both adjacent the annular groove and positioned between the annular groove and the breech end of the barrel. Each annular shoulder is provided with lug entry cutouts, which are radially spaced about the shoulder. The firearm also has a breech plug that is provided with multiple lugs forming at least one discontinuous external shoulder. The lugs are spaced and sized so that they align with the lug entry cutouts. Preferably, the number of external shoulders on the breech plug match the number of internal annular grooves in the barrel. The breech plug is installed in the barrel by aligning the lugs with the lug entry cutouts, and then rotating the plug so that the lugs are no longer aligned with the lug entry cutouts.

20 Claims, 5 Drawing Sheets

MUZZLELOADER FIREARM WITH QUICK-RELEASE BREECH PLUG

BACKGROUND OF THE INVENTION

1. Field of the Invention

The invention relates generally to firearms and, more particularly, to muzzle-loading firearms which require a breech plug.

2. History of the Prior Art

Early in 1968, President Johnson signed into law the Omnibus Crime Control Bill, which included sundry curbs on handguns, including a ban on the interstate mail-order sale thereof. However, the President did not think that ban went far enough, and so he proposed new gun legislation targeting shotguns and rifles. After prolonged and heated debate, Congress finally enacted the strongest gun control legislation in the nation's history on October 22 of that year. As finally approved, the legislation: outlawed the mail-order sales of all rifles, shotguns, and ammunition, except between licensed dealers, manufacturers, and gun collectors; banned the sale of rifles, shotguns, and handguns to persons under 21 years of age; and banned direct sales of guns to out-of-state residents unless the state involved specifically authorized its citizens to buy guns in adjoining states. Muzzleloading, black-powder firearms, though, were exempted from most of the restrictive legislation.

During the past three decades, muzzleloading firearms have enjoyed a strong resurgence in popularity. Certainly, the federal exemptions from the ban on interstate mail order sales have helped. In addition, because black-powder firearms have significantly less range and are generally less accurate than smokeless, breech-loading firearms, most states have established special seasons for muzzleloader hunting that are more favorable than those allotted to breechloader hunters. However, the most significant factor in the growing popularity of muzzleloader firearms is almost certainly the challenge associated with the use of a single shot rifle during the hunt. Muzzle-loader hunters style themselves as an elite group. A single shot with a weapon of less range, at a quarry likely made wary by other hunters who came before you, has almost irresistible appeal for many. The allure of muzzleloading hunting is the same as that afforded by flyfishing: the greater the challenge, the greater the satisfaction. Today, there are two basic types of muzzleloaders used for hunting: primitive and in-line. Both types require the introduction of a measured powder charge into the gunbarrel, and the ramming of a slug or ball down on top of the charge to load the gun.

Primitive muzzleloaders generally use either a flintlock or a caplock ignition system. The flintlock, popular from the time of the Revolutionary War through the early 1800s, is the more primitive technology. The hammer of the gun holds a piece of flint wrapped in fine leather. Below the hammer is a swinging metal plate known as the frizzen. Below the frizzen is the pan, into which the shooter pours a small amount of fine black powder. Pulling the trigger releases the hammer, which strikes the frizzen, which then folds back, thereby showering the powder in the pan with sparks. The powder ignites, shooting a tongue of flame into the barrel of the gun via a small port. This port is an ignition aperture, and directs hot ignition gasses into the barrel. The powder charge in the barrel ignites, expelling the ball or slug that has been rammed down the barrel. The foregoing process is as cumbersome as it sounds. Ignition is neither instantaneous, nor certain. A full second or more may elapse between pulling the trigger and ignition of the measured charge. Flintlock shooters must remain steady for that period.

The caplock ignition system, though the more modern of the primitive technologies, still relies on a side hammer design and the funneling of a flame into a port in the barrel. However, ignition is accomplished through a small nipple seated under the hammer. A copper percussion cap filled with a small amount of priming compound is placed atop the nipple. When the hammer falls, the cap shoots a tiny spurt of hot flame through the nipple and into the port in the barrel, thereby igniting the powder inside and expelling the slug or ball from the barrel. Ignition of the loaded charge is much more direct and rapid than with the flintlock.

The special muzzleloader hunting seasons were originally established for the intended use of primitive percussion or flintlock rifles or shotguns, using black powder and open metal sights. These types of guns have specific limitations. Loading such a gun is considerably more cumbersome and time-consuming than loading cartridges into a breechloader. Thus, the hunter may get only one shot at his game, so he'd better make it count. This necessitates getting close to the quarry, learning to shoot well with open sights, and keeping the powder dry in inclement weather.

An in-line ignition muzzleloader, on the other hand, utilizes a plunger-type hammer, which strikes a nipple centered at the rear of the breech plug. An in-line ignition is quick and reliable because the fire from the cap travels a straight, short distance into the powder charge rather than bouncing around a corner as it does in a side hammer design. In all other respects, an in-line rifle loads and shoots identically to a traditional side hammer percussion muzzleloader. In-line rifles are nothing new. Some flintlocks used in-line ignition as far back as the 1700s, although the lack of sufficiently powerful springs to drive the in-line hammers probably kept them from supplanting side-hammer rifles. In the early 1970s and 1980s a couple of rifles, most notably the Michigan Arms Wolverine, featured an in-line ignition. The Wolverine, however, had a long, heavy octagonal barrel and never caught on with shooters.

Tony Knight, a gunsmith from rural Lancaster, Mo., is generally credited with building the first modern, lightweight, in-line blackpowder rifle. Knight was no traditionalist, and figured that any hunting rifle should be equipped with a tapered 22-inch barrel. Starting with a Numrich Arms barrel, Knight added a removable, friction-securable, threaded breech plug that simplified cleaning and allowed hunters to push an unfired charge out the breech instead of having to fire the rifle or pulling the ball back out of the barrel to unload it. He also incorporated Remington sights, a handmade trigger, and a stock carved from a piece of walnut cut from a tree on his farm. Knight's first in-line design, which he christened MK-85, is considered a milestone in muzzleloader technology.

Knight's new rifle set the standard for in-line models subsequently manufactured by hundreds of competitors, both large and small. The in-line rifle business is booming. One can now purchase a gun that looks and operates very much like a modern sporting rifle. In essence, it is a modern single-shot rifle that is loaded with a ramrod. Many in-line shooters use pelletized powder, such as those produced by Pyrodex®, that can be dropped into the barrel in 50-grain increments, and saboted bullets that are constructed much like a high-powered rifle bullet, but with a plastic sleeve which allows them to be more easily rammed down the barrel. With a shotgun primer, a #11 primer cap, a musket cap, or a primer adapted from a center-fire cartridge securable in the breech to ignite the propellent charge, rain and high humidity are much less problematic, especially if the firearm is fabricated from stainless steel. Many of these modern rifles, which may be fitted with scopes and other optical sights, are capable of groupings of one inch or less at a range of 100 yards.

The use of an in-line rifle, no matter how sophisticated the features, still means single-shot, front-loading, no-mistakes hunting. An in-line hunter accepts the same challenge of placing one well-aimed shot at relatively close range. Granted, a properly loaded, scoped in-line enjoys a big advantage in effective range over an open-sighted rifle shooting round-balls. In a sense, the in-line rifle is to blackpowder what the compound bow is to archery: easier to shoot and harder-hitting than traditional gear, yet subject to the same underlying limitations.

The present invention involves a new type of breech plug. Breech plugs are used to stopper the barrel at the breech end thereof. All muzzleloading firearms do not have removable breech plugs. Early muzzleloading cannon barrels, for example, had the breech plug cast unitary with the barrel. On primitive muzzleloader rifles and pistols, the bore of the barrel does not extend to the breech. Because the combustion of black powder forms highly corrosive deposits in the barrel, frequent cleaning of muzzleloader firearms is essential. For a muzzleloader having no breech plug, cleaning the barrel and extracting an unfired charge can be quite a chore. A removable breech plug greatly simplifies those tasks, as cleaning of the barrel is most easily effected by removing the plug and running a cleaning rod through the barrel from the muzzle into the breech. One of the problems associated with conventional threaded breech plugs is that removal of the plug requires the use of a wrench or other special tool. Threaded breech plugs typically have either a polygonal socket or shank which can be engaged with a wrench. For socket-type plugs, an appropriately-sized square or hexagonal Allen wrench is used; for shank type plugs, an appropriately-sized socket, box-end or open-end wrench is used. On an in-line rifle, the firing plunger assembly can be disassembled so that the plug may be accessed directly using an extension inserted through the end of the receiver. Although removal of the firing plunger requires the expenditure of additional time and effort, it facilitates removal of the breech plug. Thus, no matter which method is used, removal of a conventional threaded breech plug is, at the very least, a nuisance.

What is needed is a new type of breech plug that may be quickly removed without tools.

SUMMARY OF THE INVENTION

The present invention fulfills the stated need for a breech plug on a muzzleloader firearm that can be removed without tools in about one second. The ease and speed of removal not only facilitates cleaning of the barrel, but enables the shooter to easily expel misfired charges through the breach, rather than attempting to extract it through the muzzle.

The invention requires a redesign of at least the breech end of the barrel and the breech plug. For the presently preferred embodiment of the invention, the rifle's receiver is also modified to include a locking aperture on a forward edge of the breech access cutout. The barrel is provided with at least one lug retaining structure that includes an internal annular groove and an internal annular shoulder that is both adjacent the annular groove and positioned between the annular groove and the breech end of the barrel. Each annular shoulder is provided with lug entry cutouts, which are radially spaced about the shoulder. The breech plug is provided with multiple lugs forming at least one crenelated external shoulder. The lugs are spaced and sized so that they align with the lug entry cutouts in the barrel. Preferably, the number of external shoulders on the breech plug match the number of internal annular grooves in the barrel. The breech plug is installed in the barrel by aligning the lugs with the lug entry cutouts, and then rotating the plug so that the lugs are no longer aligned with the lug entry cutouts. For a presently preferred embodiment of the invention, a stepped, spring-loaded detent pin is installed within a chamber located within a partial flange on the breech plug, which has external opening for an exposed, reduced-diameter end of the detent pin that faces the barrel as the breech plug is inserted therein. The exposed end of the detent pin retracts into the detent pin chamber as the partial flange contacts an edge of the receiver into which the barrel is installed. When the breech plug is rotated so that the lugs are no longer aligned with the lug entry cutouts, the exposed end of the detent pin snaps into the locking aperture in the forward edge of the breech access cutout. The detent pin can be released by pulling on a release lever which projects through the rim of the partial flange. For a preferred embodiment of the invention, the release lever is a socket-head screw that is threadably secured in an aperture within the detent pin that is perpendicular to the longitudinal axis of the detent pin.

Various embodiments of the invention are shown and described. A first main embodiment utilizes a barrel having pair of lug retaining structures, which are axially positioned within the breech-end of the barrel, one behind the other. For this embodiment, the breech plug has two circular arrays of lugs, with the lugs of one circular array being aligned with those of the other circular array. Each lug retaining structure in the barrel has at least two lug entry cutouts, and each circular array of lugs on the breech plug has a number of lugs which correspond to the number of lug entry cutouts in a single lug retaining structure in the barrel. Lug retaining structures with up to four lug entry cutouts are shown and described. More are certainly possible, but increase the complexity and difficulty of the machining process, with little or no return for the added expenditure of effort. In fact, because radiused cuts are produced by most machine tools, the total amount surface area available for lugs and lug retaining structures may actually decrease as the number of lugs increases. Although it is conceivable that a single lug entry cutout may be used for a single lug retaining structure, a breech plug having a single lug would be unable to radially distribute the load to the barrel, thereby resulting in a tipping force concentrated at a point on the outer edge of the breech plug. In addition, greater axial rotation of the plug in an arc of up to 180 degrees would be required to achieve an optimum load handling capability. Therefore, although a breech plug having a single lug or multiple longitudinally-aligned lugs has been contemplated, and is covered by the claims of this patent, it is not considered to be a preferred embodiment of the invention, as there are seemingly far better alternatives that require far less axial rotation and provide balanced radial distribution of the load from a fired charge.

A second main embodiment breech plug and barrel combination is also shown and described, in which the barrel has only a single lug retaining structure and the breech plug has only a single circular array of lugs. As with the first main embodiment of the invention, the circular array may have two or more lugs. A breech plug having four equiangularly-spaced lugs per circular array requires axial rotation of about 45 degrees to provide maximum load distribution within the barrel; with three lugs per circular array, the angle of rotation is about 60 degrees; and with two lugs per circular array, the angle or rotation is about 90 degrees.

Both main embodiments of the breech plug may be used in combination with the various types of ignition systems that are currently used and may be used in the future to ignite the power charge in the barrel. All embodiments of the lugged breech plug, which is one component of the present invention, may be modified to accept the various types of available primer caps including, but not limited to, #11 caps, musket caps, shotgun primer caps, rifle primer caps and pistol primer caps. Although the design of center-rear portion of the lugged breech plug must be specifically modified to accept the various types of primers, the lugged structure which permits quick removal of the plug is entirely unaffected by such modifications.

Although a detent pin is used to lock the breech plug of the present invention within the rifle barrel, it should be understood that this is only one of many possible mechanisms. For example, a clamping mechanism could be substituted, as could a friction screw lock. The detent pin method is advantageous because it is simple, reliable, and visually verifiable. Movement of the detent pin release lever as the detent pin locks in place provides a verifiable indication of the locked-in-place condition.

For preferred embodiments of the breech plug the lugs are unitary with a shank portion that, preferably, has a diameter only slightly less than the barrel bore diameter. This clearance is, ideally, just sufficient to provide a non-interference sliding fit. A circumferential shoulder portion is positioned between and unitary with both the shank portion and a head portion. The circumferential shoulder portion, which fits into a recess at the breech end of the barrel, complicates the exit route of any combustion gases which may escape through the clearances between the breech plug and the barrel by diverting them around two 90-degree corners. The breech end of the barrel is also equipped with an annular lip that fits into a circumferential groove in the head portion of the breech plug, thereby routing any escaping gases around three additional 90-degree corners. Using these techniques, the leakage of combustion gases between the rife bore and the periphery of the breech plug is minimized. Other types of gas seals may also be used. One or more O-ring seals, a compressible metal sealing ring, or a crushable metal sealing ring may also be used in place of, or in combination with escape route diversion seals.

BRIEF DESCRIPTION OF THE PHOTOGRAPHS

Figure 3:
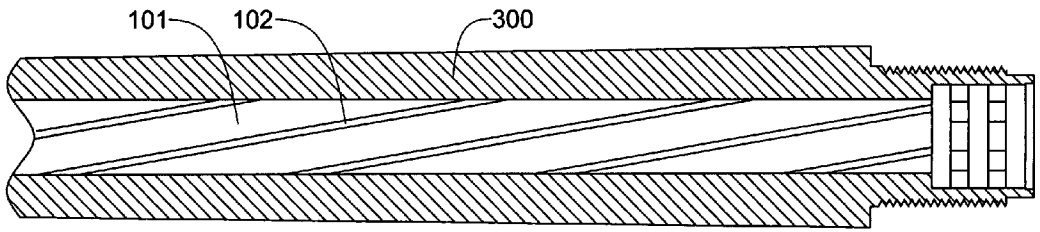
FIG. 3 is a cross-sectional view of a first embodiment rifle barrel, created by machining four equiangularly-spaced lug entry cutouts between each adjacent pair of interior annular grooves in the rifle barrel of FIG. 1.
Figure 4:
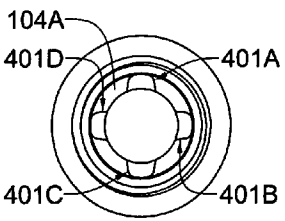
FIG. 4 is a breech end view of the first embodiment rifle barrel of FIG. 3.
Figure 7:
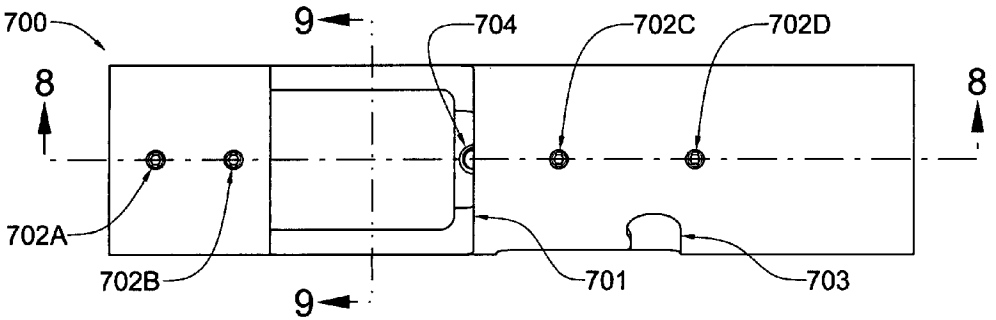
FIG. 7 is a top plan view of a receiver manufactured in accordance with the present invention.
Figure 9:
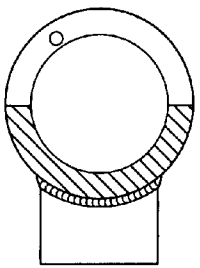
FIG. 9 is a cross sectional view of the receiver of FIG. 7, taken through section line 9-9.
Figure 8:
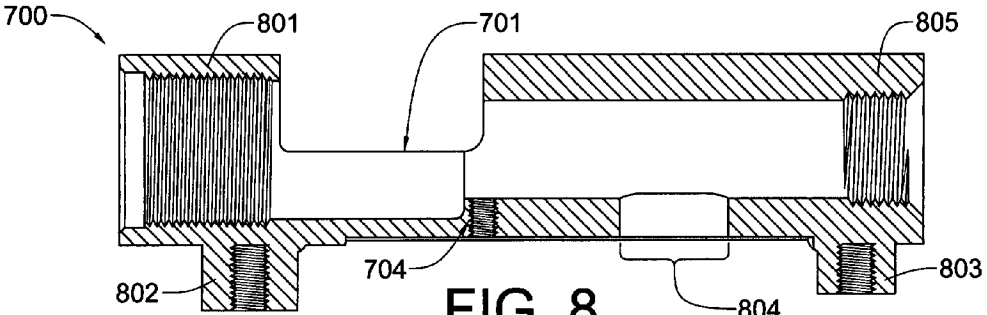
FIG. 8 is a cross-sectional view of the receiver of FIG. 7, taken through section line 8-8.
Figure 27:
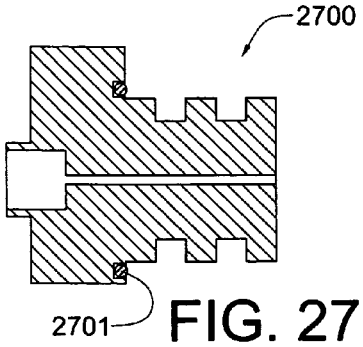
FIG. 27 is a cross-sectional view of an alternative first main embodiment non-friction-fit, eight-lug breech plug, similar to that shown in FIG. 13, having an O-ring installed in the circumferential groove.
Figure 28:
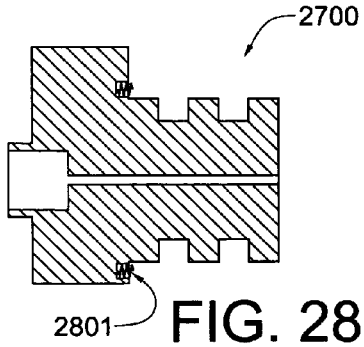
Figure 29:
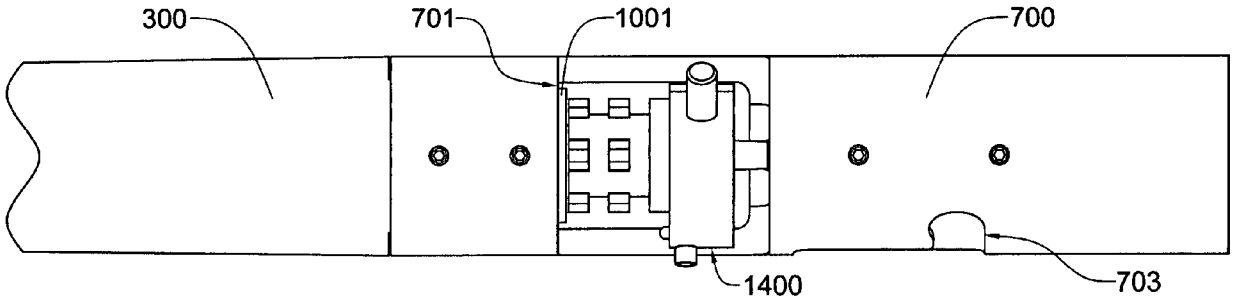
Figure 30:
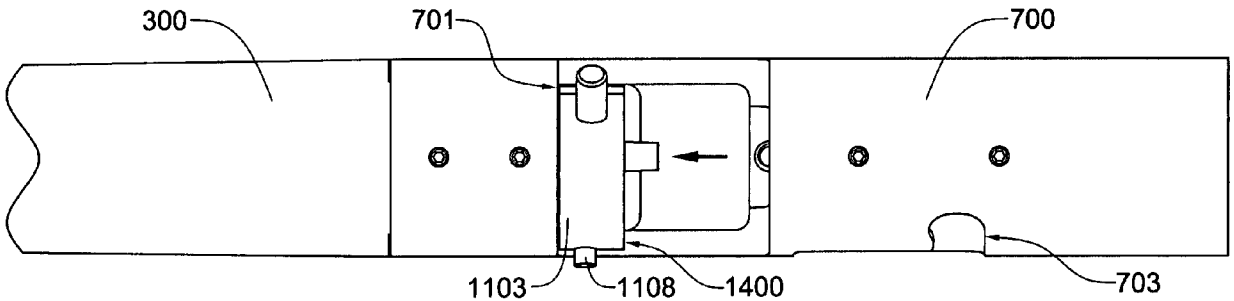
Figure 31:
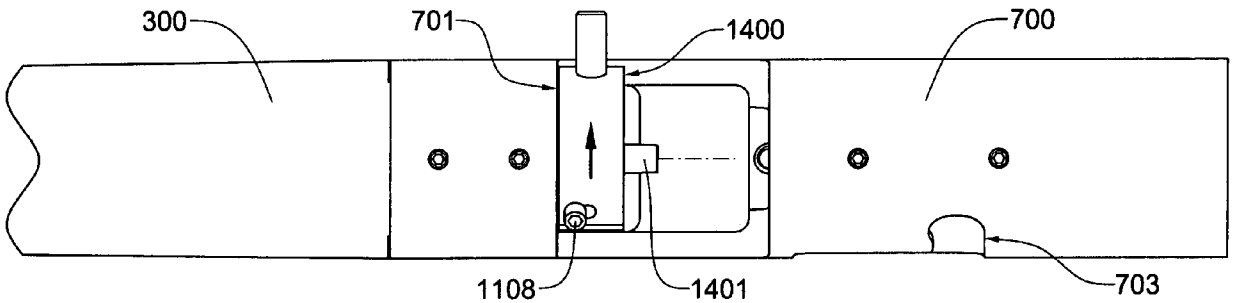

FIG. 28 a cross-sectional view of the alternative first main embodiment non-friction-fit, eight-lug breech plug of FIG. 27, with a crushable or compressible metal sealing ring installed in the circumferential groove in place of the O-ring;

FIG. 29 is a top elevational view of the first embodiment rifle barrel of FIGS. 3 and 4 installed in the receiver of FIGS. 7, 8 and 9, together with a first main embodiment non-friction-fit eight-lug adapted for use with #11 primer caps that has been placed within the receiver chamber, but before insertion into the breech of the rifle barrel;

FIG. 30 is a top elevational view of the first embodiment rifle barrel, receiver and breech plug of FIG. 27, subsequent to insertion of the breech plug into the breech of the rifle barrel, but before it is rotated to lock it into place; and FIG. 31 is a top elevational view of the first embodiment rifle barrel, receiver and breech plug of FIG. 29, subsequent to axial rotation of the breech plug to lock it into the breech of the barrel.

DETAILED DISCLOSURE OF THE INVENTION

The invention will now be described in detail with reference to the twenty-nine attached drawing figures. It should be understood that although the drawings are closely drawn to scale for a 0.50-inch caliber muzzleloader, they are intended to be merely illustrative. The invention should not be considered limited to any particular caliber or even to shoulder-fired weapons. The invention is as applicable to muzzleloader handguns as it is to muzzleloader rifles. Although the invention is disclosed in the context of a modern, inline muzzleloader rifle, it may also be readily applied to muzzleloaders of side-hammer design. This would involve merely a change in the ignition path through the breech plug in accordance with standard practice for the various side-hammer ignition systems, but would not affect the lugged securing structure in the least. In short, it is applicable to any muzzleloader firearm on which the designer desires to incorporate a breech plug.

Figure 1:
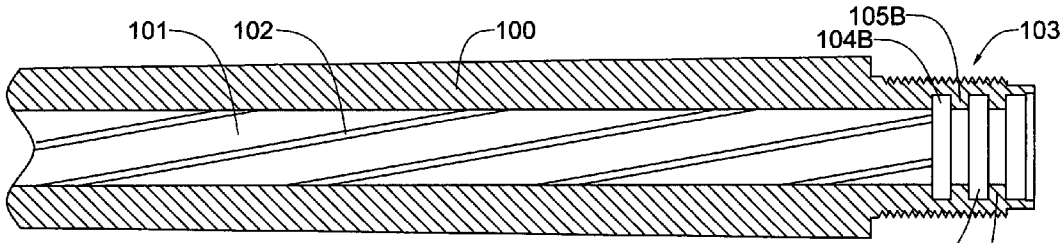
FIG. 1 is a cross-sectional view taken through the central axis of a tapered muzzleloader rifle barrel that has been machined with three internal annular grooves at the breech end thereof.
Figure 2:
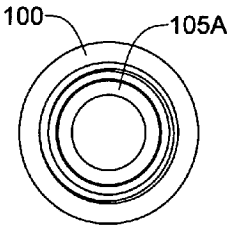
FIG. 2 is a breech end view of the rifle barrel of FIG. 1.

Referring now to FIGS. 1 and 2, a first main embodiment tapered rifle barrel 100 having a bore 101 with internal rifling 102 and a threaded breech end 103 for installing within a rifle receiver is shown at an intermediate manufacturing stage. First and second annular grooves 104A and 104B, respectively, have been machined near the breech end of the barrel 100. Immediately to the right of the first annular groove 104A is an associated first annular shoulder 105A, and to the right of second annular groove 104B is an associated second annular shoulder 105B. Each annular groove 104A or 104B and its associated annular shoulder 105A or 105B, respectively, together comprise a lug retaining structure. For a preferred embodiment of the invention, the rifle barrels, receiver, and breech plugs shown in this disclosure are fabricated from stainless steel. However, they may also be fabricated from a variety of strong steel alloys which incorporate such other metals as chromium, molybdenum, manganese, and nickel. The drawback to using conventional steel alloys is that they are not as resistant to corrosion by moisture and black powder combustion products.

Referring now to FIGS. 3 and 4, the rifle barrel 100 of FIGS. 1 and 2 has been transformed into a completed first embodiment rifle barrel 300 by subjecting the former to an additional machining operation, whereby it is provided with four equiangularly-spaced lug entry cutouts 401A, 401B, 401C and 401D that have been cut through the first and second annular shoulders 104A and 104B.

Figure 5:
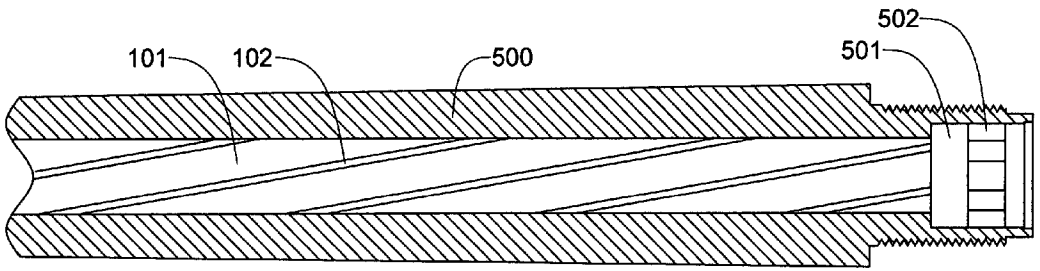
FIG. 5 is a cross-sectional view of a second embodiment rifle barrel, created by machining four equiangularly-spaced lug entry cutouts between a single pair of interior annular grooves in a rifle barrel.
Figure 6:
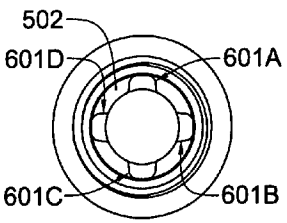
FIG. 6 is a breech end view of the second embodiment rifle barrel of FIG. 5.

Referring now to FIGS. 5 and 6, a second embodiment rifle barrel 500 has only a single lug retaining structure, which is comprised of a single internal groove 501 and a single internal annular shoulder 502. It will be noted that both the single internal groove 501 and the single internal annular shoulder 502 are wider than those of the first embodiment rifle barrel of FIGS. 1 to 4. However, as with the illustrated first main embodiment rifle barrel 100, four equiangularly-spaced lug entry cutouts 601A-601D have been cut through the single internal annular shoulder 502.

Referring now to FIG. 7, a generally tubular rifle receiver 700 includes a breech access cutout 701, four threaded optical scope mounting apertures 702A-702D, and a cocking lever slot 703. A threaded, trigger assembly mounting screw hole 704 can be partially seen.

Referring now to FIG. 8, this cross-sectional side view of the receiver 700 shows a threaded front portion 801, into which the threaded breech end of the a rifle barrel 300 or 500 can be threadably installed. The breech access cutout 701 is seen here, too, from a different perspective. The treaded, trigger assembly mounting screw hole 704 is readily visible in cross-section format, as are a threaded front stock mount 802, a threaded rear stock mount 803, a trigger assembly sear aperture 804, and a threaded rear portion 805. A threaded end plug (not shown) screws into the right end of the receiver 700 and retains the firing plunger and spring (also not shown).

Referring now to FIG. 9, a detent pin aperture 901 is drilled in the forward upper edge 902 of the breech access cutout 701 in the receiver 700.

Figure 10:
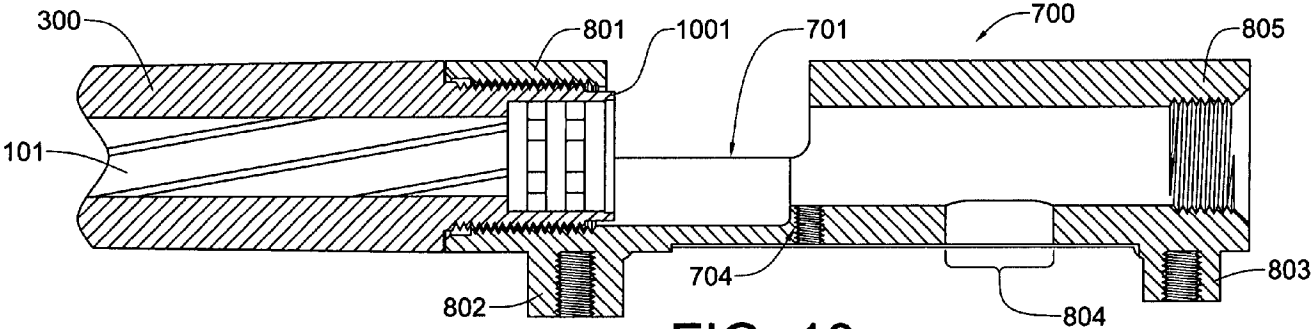
FIG. 10 is a cross-sectional view of the barrel of FIG. 3 installed within the receiver of FIGS. 7, 8 and 9.

Referring now to FIG. 10, a rifle barrel 300 of FIG. 3 has been installed in the receiver of FIGS. 7, 8 and 9. It will be noted that an annular lip 1001 at the extreme breech end of the barrel 300 extends into the breech access cutout 701 in the receiver.

Figures 11, 12, 13, 14, 15, 16, 17, 18, 19, 20:
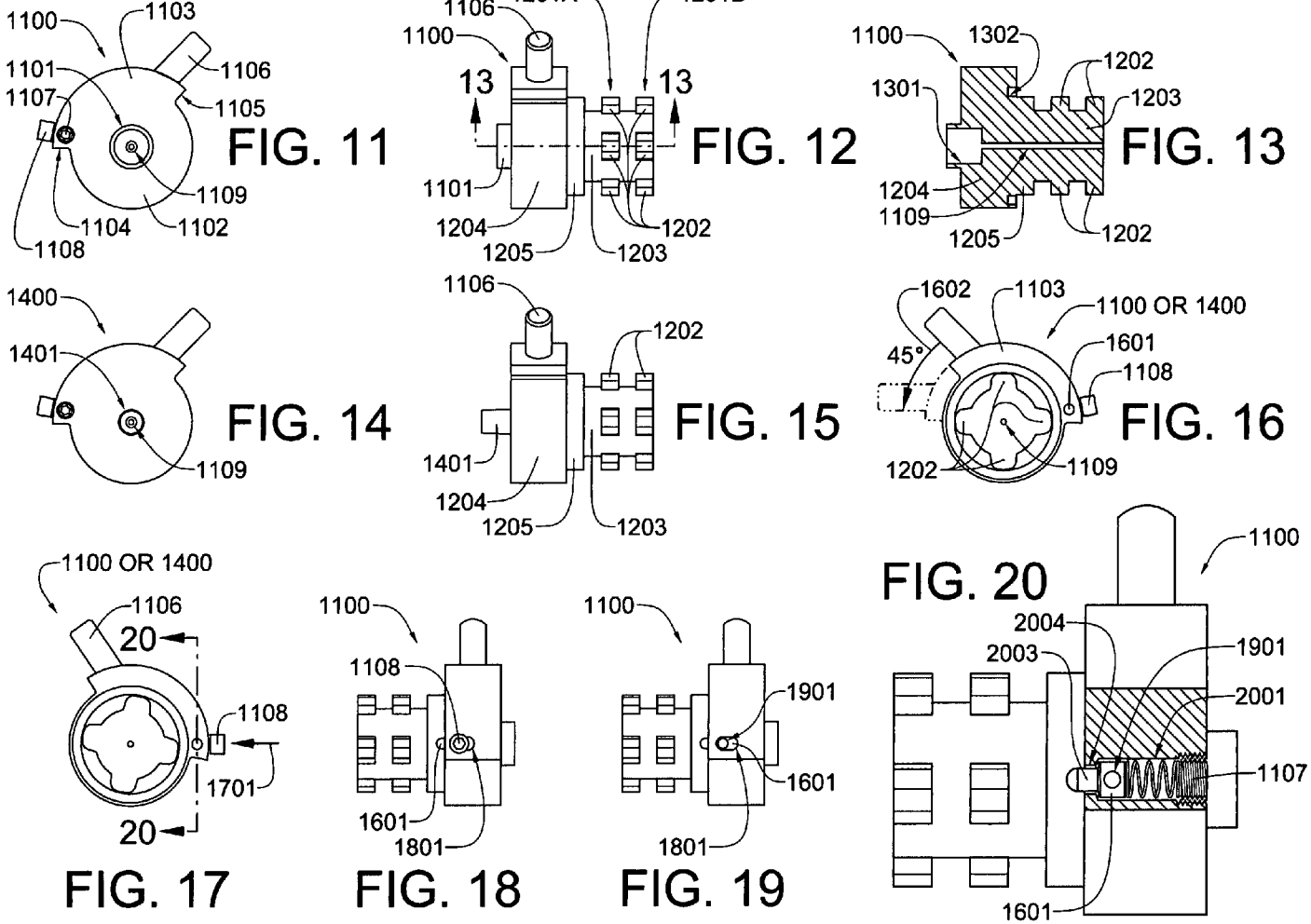
FIG. 11 is a rear elevational view of a first main embodiment non-friction-fit, eight-lug breech plug, installable via axial rotation of 45 degrees in the breech of the first embodiment barrel of FIGS. 3 and 4, and adapted for use with shotgun primer caps.
FIG. 12 is a right-side elevational view of the first main embodiment non-friction-fit, eight-lug breech plug of FIG. 11.
FIG. 13 is a cross-sectional view of the first main embodiment non-friction-fit, eight-lug breech plug, taken through section line 13-13 of FIG. 12.
FIG. 14 is a rear elevational view of an alternative first main embodiment non-friction-fit, eight-lug breech plug, installable via axial rotation of 45 degrees in the breech of the first embodiment barrel of FIGS. 3 and 4, and adapted for use with #11 primer caps.
FIG. 15 is a right-side elevational view of the first main embodiment non-friction-fit, eight-lug breech plug of FIG. 14.
FIG. 16 is a front elevational view of the first main embodiment non-friction-fit, eight-lug breech plug of either FIG. 11 or FIG. 14.
FIG. 17 is a front elevational view of the first main embodiment non-friction-fit, eight-lug breech plug of FIG. 16, following clockwise axial rotation through an arc of about 12 degrees.
FIG. 18 is a left-side elevational view of the first main embodiment non-friction-fit, eight-lug breech plug of FIG. 17.
FIG. 19 is a left-side elevational view of the first main embodiment non-friction-fit, eight-lug breech plug of FIG. 17, following removal of the socket head screw which functions as a release knob for the detent pin.
FIG. 20 is an enlarged, partial cross-sectional view of the first main embodiment, non-friction-fit, eight-lug breech plug, taken through section line 20-20 of FIG. 17, and showing the detent pin mechanism.

Referring now to FIG. 11, a first main embodiment non-friction-fit breech plug 1100 fabricated in accordance with the present invention, and adapted for use with shotgun primer caps, is installable within the barrel 300 of FIGS. 3 and 4. It should be explained that from this view, it is impossible to determine whether the breech plug is a first or second main embodiment, as the lug configuration on the shank of the breech plug is not visible. In this drawing, the breech plug 1100 is shown from the rear. The shotgun cap installation nipple 1101 is visible, as is the generally circular head 1102. The head 1102 is equipped with a locator flange 1103, which spans only a portion of the circumference of the head 1102. As a four-lug retaining structure is installable in the breech end of barrels 300 or 500 via axial rotation of 45 degrees, the locator flange 1103 of this particular breech plug 1100 is arcuately sized for a lug retaining structure having at least one circular array of four equiangularly-spaced lugs. The left edge 1104 of the locator flange 1103 is adjacent the left side upper edge of the breech access cutout 701 when the breech plug 1100 is inserted into the rifle barrel 300 or 500. After the breech plug 1100 is axially rotated to secure it in the rifle barrel, the right edge 1105 of the locator flange 1103 is adjacent the right side upper edge of the breech access cutout 701. It will be noted that a rotation lever 1106 is installed in the locator flange 1103, as is a detent pin mechanism, of which only the socket retaining screw 1107 and socket head screw 1108, which functions as a release lever for the detent pin, are visible. As this breech plug 1100 is designed for an in-line rifle, there is a central ignition aperture 1109 that passes from the rear side of the plug to the front side, and functions to direct hot gasses of an ignition charge through the breech plug from a location outside the breech end of the barrel to a combustion region within the breech end of the barrel.

Referring now to FIG. 12, the first main embodiment breech plug 1100 having two parallel circular arrays 1201A and 1201B, each of which comprise four equiangularly-spaced lugs 1202, is shown in this side view. This particular embodiment has a cylindrical shank portion 1203, a head portion 1204, and a circumferential shoulder portion 1205 positioned between the head portion 1204 and the shank portion 1203. A shotgun cap nipple 1206 is positioned at the rear of the breech plug 1100. For a preferred embodiment of the invention, the lugs 1202, the shank portion 1203, the head portion 1204, the circumferential shoulder portion 1205, and the cap nipple 1206 are fabricated from a monolithic piece of stainless steel. In this view, the rotation lever 1106 and the locator flange 1103 are also visible.

Referring now to FIG. 13, this cross sectional view of the first main embodiment breech plug 1100 shows the interior recess 1301 of the cap nipple 1206, the central aperture 1107 characteristic of a breech plug used on an in-line rifle, and a circumferential groove 1302 in the head portion 1204.

Referring now to FIG. 14, this alternative first main embodiment non-friction-fit breech plug 1400 is similar to that of FIGS. 11,12 and 13, except that it is designed for use with #11 primer caps. The #11 primer cap nipple 1401 is smaller is diameter than the shotgun primer cap nipple 1206. In all other significant respects, the breech plugs 1100 and 1400 are essentially identical.

Referring now to FIG. 15, it will be seen that the #11 primer cap nipple 1401 is not only smaller in diameter than the shotgun primer cap nipple 1206, it is considerably longer, as well.

Referring now to FIG. 16, this front view of the first main embodiment non-friction-fit breech plug 1100 or 1400 shows the profile of the lugs 1202 in the lug arrays 1201A and 1201B, both of which are aligned with respect to one another. Also visible in this view is the detent pin 1601, which locks the breech plug 1100 or 1400 in the barrel at an angle of rotation where the lugs 1202 are fully misaligned with the lug entry cutouts 401A-401D in the barrel 300. The arrow 1602 shows the 45-degree angle of rotation required to rotate the breech plug 1100 or 1400 to its proper locked position in the barrel 300. It will be noted the circumferential groove 1302 is visible in this view.

Referring now to FIG. 17, the breech plug shown in FIG. 16 has been axially rotated in a clockwise direction through an arc of about 12 degrees to that the axis of the socket head screw 1108, which serves as the release lever of the detent pin 1601, is parallel to the viewing angle.

Referring now to FIG. 18, this lift-side view of the first main embodiment breech plug 1100, that is designed to accept shotgun primer caps, shows a head-on view of the socket head screw 1108, as well as a portion of the elongate slot 1801 in which the socket head screw 1108 travels as the detent pin 1601 move to the right.

Referring now to FIG. 19, the socket head screw 1108, which functions as the release lever of the detent pin 1601, has been removed, with the elongate slot 1801 now fully visible, as well as a portion of the detent pin 1601 and the threaded aperture 1901 in the detent pin 1601 into which the socket head screw 1108 may be threadably inserted.

Referring now to FIG. 20, this enlarged, partial cross-sectional view of the first main embodiment, double circular four-lug array, non-friction-fit, eight-lug breech plug. The detent pin mechanism is clearly visible in this view. The detent pin 1601 is trapped within a cylindrical chamber 2001. A detent spring 2002 biases the detent pin 1601 so that the narrow cylindrical tip 2003 thereof extends through the restricted aperture 2004 at the open end of the of the chamber. A threaded socket plug 1107 seals the opposite end of the chamber and compresses the detent spring 2002. The threaded aperture 1901 in the detent pin is visible in this view.

Figure 21:
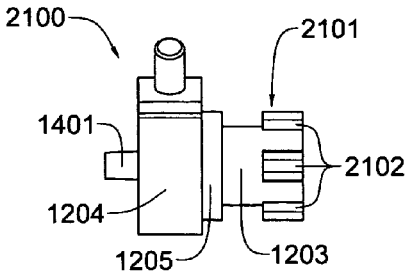
FIG. 21 is a right-side elevational view of a second main embodiment non-friction-fit, four-lug breech plug installable via axial rotation of 45 degrees in the breech of the second embodiment barrel of FIGS. 5 and 6, and adapted for use with #11 primer caps.

Referring now to FIG. 21, a second main embodiment non-friction-fit, four-lug breech plug 2100, installable via axial rotation of 45 degrees in the breech of the second embodiment barrel of FIGS. 5 and 6, and adapted for use with #11 primer caps, has but a single circular array of lugs 2101. It will be noted that the lugs 2102 are about twice the width of the lugs 1202 of the first main embodiment breech plug 1100 or 1400.

Figure 22:
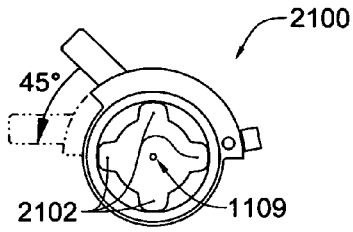
FIG. 22 is a front elevational view of the second main embodiment non-friction-fit, eight-lug breech plug of FIG. 21.

Referring now to FIG. 22, the second main embodiment breech plug 2100 has a front view that is identical to that of the first main embodiment breech plugs shown in FIG. 16, and the rotational locking angle for breech plugs with a four lug array is the same at 45 degrees.

Figure 23:
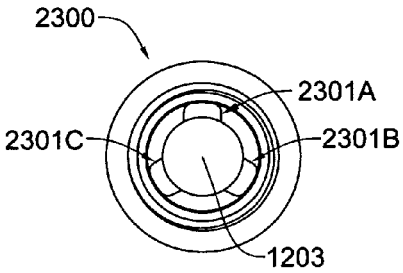
FIG. 23 is a breech-end elevational view of a third embodiment rifle barrel, created by machining three equiangularly-spaced lug entry cutouts between the annular grooves in of the rifle barrel of FIG. 1.

Referring now to FIG. 23, a third embodiment rifle barrel 2300 has been created by machining three equiangularly-spaced lug entry cutouts 2301A-2301C between the annular grooves in of the rifle barrel 100 of FIG. 1.

Figure 24:
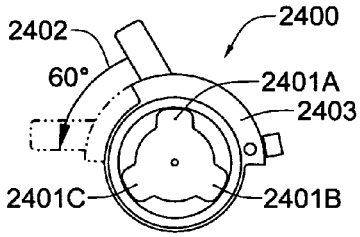
FIG. 24 is a front elevational view of a third main embodiment non-friction-fit, six-lug breech plug installable via axial rotation of 60 degrees in the breech of the third embodiment barrel of FIG. 23.

Referring now to FIG. 24, a third main embodiment non-friction-fit breech plug 2400 has at least one circular array of three lugs 2401A-2401C. The third main embodiment breech plug is installable via axial rotation of 60 degrees in the breech of the third embodiment barrel 2300 of FIG. 23. It should be evident that a breech plug having either a single circular array of lugs, such as the second embodiment breech plug 2100 of FIG. 21, or a breech plug having a double circular array of lugs, such as the first embodiment breech plugs 1100 and 1400 of FIGS. 11 and 14, respectively, may be fabricated. Of course, the number of circular arrays of lugs on the breech plug must match the number of annular grooves and annular shoulders machined in the barrel, and the number of lugs per circular array must match the number of lug entry cutouts in the barrel. The arrow 2402 shows the 60-degree angle of rotation required to rotate the breech plug 1100 or 1400 to its proper locked position in the barrel 300. As a consequence of this greater angle, the arcuate sweep of the locator flange 2403 has been reduced as compared with the locator flange 1103 of the four-lugs per array embodiments of FIGS. 11, 14 and 22.

Figure 25:
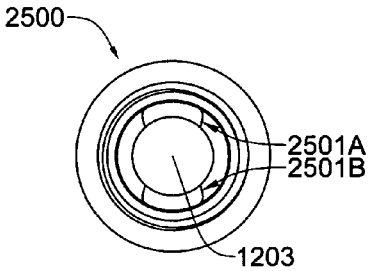
FIG. 25 is a breech-end elevational view of a fourth embodiment rifle barrel, created by machining two equiangularly-spaced lug entry cutouts between the annular grooves in the rifle barrel of FIG. 1.

Referring now to FIG. 25, a fourth embodiment rifle barrel 2500 has been created by machining two equiangularly-spaced lug entry cutouts 2501A and 2501B between the annular grooves in of the rifle barrel 100 of FIG. 1.

Figure 26:
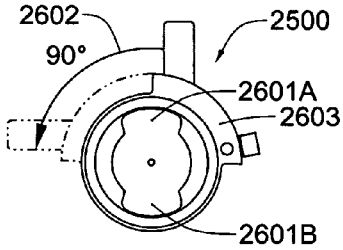
FIG. 26 is a front elevational view of a fourth main embodiment non-friction-fit, four-lug breech plug installable via axial rotation of 90 degrees in the breech of the fourth embodiment rifle barrel of FIG. 25.

Referring now to FIG. 26, a fourth main embodiment non-friction-fit breech plug 2600 has at least one circular array of two lugs 2601A and 2601B. The fourth main embodiment breech plug is installable via axial rotation of 90 degrees in the breech of the third embodiment barrel 2500 of FIG. 25. It should be evident that a breech plug having either a single circular array of lugs, such as the second embodiment breech plug 2100 of FIG. 21, or a breech plug having a double circular array of lugs, such as the first embodiment breech plugs 1100 and 1400 of FIGS. 11 and 14, respectively, may be fabricated. Of course, the number of circular arrays of lugs on the breech plug must match the number of annular grooves and annular shoulders machined in the barrel, and the number of lugs per circular array must match the number of lug entry cutouts in the barrel. The arrow 2602 shows the 90-degree angle of rotation required to rotate the breech plug 1100 or 1400 to its proper locked position in the barrel 300. As a consequence of this greater angle, the arcuate sweep of the locator flange 2603 has been reduced as compared with the locator flange 1103 of the four-lugs per array embodiments of FIGS. 11, 14 and 22.

Referring now to FIG. 27, this alternative first main embodiment lugged breech plug 2700, is similar to that shown in FIG. 13, with the exception that the depth of the circumferential groove 1302 has been reduced and an O-ring 2701 has been installed therein. For this embodiment the annular lip 1001 at the extreme breech end of the barrel 300 is trimmed so that it does not extend into the circumferential groove 1302. Thus, when this alternative embodiment lugged breech plug 2700 is installed in the barrel 300, the O-ring is compressed, thereby prevent combustion gases produced by an exploding charge in the barrel from leaking through the clearances between the breech plug 2700 and the barrel 300.

Referring now to FIG. 28, the O-ring has been removed from the alternative first main embodiment lugged breech plug 2700 of FIG. 27 and replaced with a metal seal 2801 that is either crushable or compressible, depending on the metal or metal alloy from which it is made. Copper, for example, has little memory, and tends to crush. Brass, on the other hand, tends to both crush and resiliently compress. Either type of seal will prevent combustion gasses produced by an exploding charge in the barrel from leaking through clearances between the breech plug 2700 and the barrel 300.

Referring now to FIG. 29, a first embodiment rifle barrel 300 of FIGS. 3 and 4 has been installed in the receiver 700 of FIGS. 7, 8 and 9. A first main embodiment non-friction-fit breech plug 1400 of FIGS. 14,15 and 16 has been placed within the breech access cutout 701 in the receiver 700, but has not yet been inserted into the bore of the rifle barrel 300.

Referring now to FIG. 30, the breech plug 1400 has been inserted into the bore of the rifle barrel 300, but has not yet been rotated to lock it into place. It will be noted that the detent pin has been moved rearward as the locator flange 1103 has been pressed against the forward upper edge 902 of the breech access cutout 701 in the receiver 700, as evidenced by the rearward movement of the socket head screw 1108, which serves as the release lever of the detent pin 1601.

Referring now to FIG. 31, the breech plug 1400 has been rotated 45 degrees in order to misalign the lugs 1202 thereon with the lug entry cutouts 401A-401D. Once fully misaligned, the detent pin locks into the detent pin aperture 901 in the forward upper edge 902 of the breech access cutout 701, as evidenced by the forward movement of the socket head screw 1108.

It is simple to determine that the formula for calculating the number of degrees that a lugged breech plug should be rotated to lock it in the barrel is 360/2n, where n is the number of lugs per circular array (and, if maximum strength is to be achieved, n is the number of lug entry cutouts in the breech end of the barrel). Thus, a breech plug having 5 lugs per array would require axial rotation of only 36 degrees to fully misalign the lugs with the lug entry cutouts in the barrel. A six-lug array would require 30 degrees. It would be possible, for example, to create a breech plug having, for example, eight equiangularly-spaced lugs per circular array, then remove every other lug in the array to leave only four in the array. It would, then, still be possible to secure the plug within a barrel having eight equiangularly spaced lug entry cutouts. However, there is no good reason to fabricate such a configuration, as the strength of the plug would be reduced by removing half of the lugs.

Although only several embodiments of the present invention have been disclosed herein, it will be obvious to those having ordinary skill in the art that changes and modifications may be made thereto without departing from the scope and spirit of the invention as hereinafter may be claimed.

What is claimed is:

1. A muzzleloader firearm comprising:

a barrel having a breech end, a generally cylindrical bore and at least one lug retaining structure at the breech end of the bore, said lug retaining structure including an internal annular groove and an internal annular shoulder that is both adjacent the annular groove and positioned between the annular groove and the breech end of the barrel, wherein each annular shoulder is provided with lug entry cutouts;

a breech plug having a shank portion that is sized to slidably enter the bore of said barrel at the breech end, said shank portion having an array of lugs that are spaced and sized to align with the lug entry cutouts in the barrel; and an ignition aperture, extending through the breech plug, configured to direct ignition gasses from a location outside the breech end to a combustion region within the breech end.

2. The muzzleloader firearm of claim 1, wherein the number of lug arrays on the breech plug shank match the number of internal annular grooves in the barrel.

3. The muzzle loader firearm of claim 2, wherein said at least one lug retaining structure is provided with two lug entry cutouts, said breech plug has a number of lug arrays matching the number of lug retaining structures, each lug array has two lugs, and wherein said breech plug is rotated about 90 degrees in order to lock it in place within the breech end of the barrel.

4. The muzzle loader firearm of claim 2, wherein said at least one lug retaining structure is provided with three lug entry cutouts, said breech plug has a number of lug arrays matching the number of lug retaining structures, each lug array has three lugs, and wherein said breech plug is rotated about 60 degrees in order to lock it in place within the breech end of the barrel.

5. The muzzle loader firearm of claim 2, wherein said at least one lug retaining structure is provided with four lug entry cutouts, said breech plug has a number of lug arrays matching the number of lug retaining structures, each lug array has four lugs, and wherein said breech plug is rotated about 45 degrees in order to lock it in place within the breech end of the barrel.

6. The muzzleloader firearm of claim 1, wherein said breech plug is securable within said breech end of said bore by axially rotating the breech plug so that the lugs thereon are misaligned with the lug entry cutouts.

7. The muzzleloader firearm of claim 1, wherein said breech plug further comprises a head portion coupled to said shank portion, said head portion remaining generally outside said bore when said shank portion is fully installed therein.

8. The muzzleloader firearm of claim 7, which further comprises a generally tubular receiver into which the breech end of said barrel is threadably inserted at a first end thereof, said receiver having a breech access cutout that is set back from said first end, said breech access cutout having a front edge that is about radially aligned with the breech end of said barrel, said head portion including a locator flange that incorporates a chamber housing a detent pin and a detent pin biasing spring, said chamber open at a forward end so that an end of said detent pin projects therefrom, said detent pin moving rearward as the locator flange is pressed against said front edge, said projecting end entering a detent pin aperture located on said front edge when the breech plug has been axially rotated sufficiently to misalign the lugs on said breech plug with the lug entry cutouts in said barrel.

9. The muzzle loader firearm of claim 7, wherein leakage of combustion gases through clearances between the barrel and the breech plug is controlled by incorporating at least one abrupt angular directional change in an escape path through those clearances.

10. The muzzle loader firearm of claim 7, wherein leakage of combustion gases through clearances between the barrel and the breech plug is controlled with a seal selected from the group consisting of O-rings, resilient metal seal rings, and crushable metal seal rings.

11. The muzzle loader firearm of claim 1, wherein the lug entry cutouts are equiangularly and radially spaced about the annular shoulder.

12. A muzzleloader firearm comprising:

a barrel having a generally cylindrical bore and at least one lug retaining structure at a breech end of the bore;

a breech plug having a generally cylindrical shank portion to which is affixed at least one radially-projecting lug, said shank portion being sized to slideably enter said cylindrical bore, said breech plug being securable within said breech end of said bore by axially rotating the breech plug a partial turn so that the lug retaining structure blocks said at least one lug on said breech plug, thereby preventing said breech plug from being ejected by an exploding charge in the barrel; and an ignition aperture, extending through the breech plug, configured to direct ignition gasses from a location outside the breech end to a combustion region within the breech end.

13. The muzzleloader firearm of claim 12, wherein each of said lug retaining structures includes an internal annular groove and an internal annular shoulder provided with at least two lug entry cutouts, said internal annular shoulder being both adjacent the annular groove and positioned between the annular groove and the breech end of the barrel; and said shank portion has affixed thereto at least one array of radially projecting lugs, the number of arrays matching the number of lug retaining structures in the barrel, the number of lugs per array matching the number of lug entry cutouts in the barrel, and the lugs sized and spaced to fit through the lug entry cutouts.

14. The muzzleloader firearm of claim 13, wherein said lug entry cutouts and the lugs in each array are equiangularly spaced.

15. The muzzleloader firearm of claim 12, wherein said breech plug is locked at the proper position of axial rotation by a detent pin which projects from the breech plug and engages a locking aperture that is non-movable with respect to the barrel.

16. The muzzleloader firearm of claim 13, wherein said breech plug further comprises a head portion coupled to said shank portion, said head portion remaining generally outside said bore when said shank portion is fully installed therein.

17. The muzzleloader firearm of claim 16, which further comprises a generally tubular receiver into which the breech end of said barrel is threadably inserted at a first end thereof, said receiver having a breech access cutout that is set back from said first end, said breech access cutout having a front edge that is about radially aligned with the breech end of said barrel, said head portion including a locator flange that incorporates a chamber housing a detent pin and a detent pin biasing spring, said chamber open at a forward end so that an end of said detent pin projects therefrom, said detent pin moving rearward as the locator flange is pressed against said front edge, said projecting end entering a detent pin aperture located on said front edge when the breech plug has been axially rotated sufficiently to misalign the lugs on said breech plug with the lug entry cutouts in said barrel.

18. The muzzle loader firearm of claim 16, wherein leakage of combustion gases through clearances between the barrel and the breech plug is controlled by incorporating at least one abrupt angular directional change in an escape path through those clearances.

19. The muzzle loader firearm of claim 16, wherein leakage of combustion gases through clearances between the barrel and the breech plug is controlled with a seal selected from the group consisting of O-rings, resilient metal seal rings, and crushable metal seal rings.

20. The muzzleloader firearm of claim 13, wherein an angle through which the breech plug is rotated so that the lug retaining structure completely blocks said at least one lug is equal to 360/2n, where n is the number of lug entry cutouts in the barrel.

* * * * *